US008180086B2

(12) United States Patent
Imamura et al.

(10) Patent No.: US 8,180,086 B2
(45) Date of Patent: May 15, 2012

(54) SPEAKER

(75) Inventors: Satoshi Imamura, Kanagawa-ken (JP); Junji Iino, Kanagawa-ken (JP); Shinji Kamimura, Kanagawa-ken (JP)

(73) Assignee: JVC Kenwood Corporation, Yokohama-shi (JP)

( * ) Notice: Subject to any disclaimer, the term of this patent is extended or adjusted under 35 U.S.C. 154(b) by 375 days.

(21) Appl. No.: 12/458,074

(22) Filed: Jun. 30, 2009

(65) Prior Publication Data

US 2010/0067733 A1 Mar. 18, 2010

(30) Foreign Application Priority Data

Sep. 12, 2008 (JP) ..... P2008-234846
Mar. 18, 2009 (JP) ..... P2009-065854

(51) Int. Cl.
*H04R 25/00* (2006.01)

(52) U.S. Cl. ..... 381/345; 381/349; 381/386

(58) Field of Classification Search ..... 381/345, 381/346, 348, 349, 352, 353, 354, 386, 395, 381/87, 337; 181/146, 151, 155, 156, 198, 181/199

See application file for complete search history.

(56) References Cited

U.S. PATENT DOCUMENTS 3,789,953 A * 2/1974 Everitt ..... 181/199
3,941,207 A * 3/1976 Croup ..... 181/199
2008/0149418 A1* 6/2008 Imamura et al. ..... 181/199

FOREIGN PATENT DOCUMENTS

JP 10-304492 A 11/1998
JP 2001-054182 A 2/2001

* cited by examiner

*Primary Examiner* — Huyen D Le
(74) *Attorney, Agent, or Firm* — The Nath Law Group; Jerald L. Meyer; Stanley N. Protigal

(57) ABSTRACT

A speaker includes a box-shaped enclosure, a speaker unit and a sounding board. A pair of side plates, a bottom plate, a top plate, a back plate and a baffle are assembled into the enclosure. The speaker unit is attached to an opening portion of the baffle. The sounding board is attached to the bottom plate, and includes a member having a fiber direction in a vibration direction of a vibrating plate, a member having a fiber direction in a direction which approaches the side plate (of the front side) as extending from a side of the back plate to a side of the baffle, and a member having a fiber direction in a direction which approaches the side plate (of the back side) as extending the side of the back plate to the side of the baffle.

9 Claims, 12 Drawing Sheets

SPEAKER

BACKGROUND OF THE INVENTION

1. Field of the Invention

The present invention relates to a speaker that increases sound quality by improving a structure in an enclosure.

2. Description of the Related Art

A speaker includes an enclosure and a speaker unit. A pair of side plates, a bottom plate, a top plate, a back plate and a baffle are assembled into the box-shaped enclosure. The speaker unit is attached to an opening portion formed on the baffle. For example, each plate of the enclosure is made of a wooden plate. As cited in a patent document 1 (Japanese Unexamined Patent Application Publication No. 2001-54182), the enclosure is called a speaker cabinet.

Sound generated by the speaker includes sound generated by a diaphragm itself of the speaker unit and sound generated by one or more plates of the enclosure vibrating according to the vibration of diaphragm. Various improvements for increasing sound quality of speaker, that is improvements for increasing resolution of sound generated by the speaker and reproducing sound from the speaker with rich sound field, have been carried out. As one example of the improvements, the diaphragm is made with wood. For example, a wooden diaphragm is cited in a patent document 2 (Japanese Unexamined Patent Application Publication NO. H10(1998)-304492).

The wooden diaphragm described in the patent document 2 improves sound generated by the diaphragm itself of the speaker unit, which provides a speaker capable of reproducing sound in high sound quality. However, in order to further increase sound quality of speaker, it is insufficient to only improve sound generated by a diaphragm itself and it is necessary to improve sound generated by an enclosure.

SUMMARY OF THE INVENTION

The present invention is invented in order to solve the above-described problems, and has an object to provide a speaker that improves sound generated by an enclosure by improving a structure in the enclosure to further increase sound quality of the speaker.

In order to solve the above-described conventional technical problem, the present invention provides a speaker (100, 100L, 100R) comprising: a box-shaped enclosure (6) into which a first side plate (1), a second side plate (1), a bottom plate (2), a top plate (3), a back plate (4) and a baffle (5) with an opening portion (5*a*) are assembled; a speaker unit (7) that is attached to the opening portion such that a vibrating plate (7*a*) of the speaker unit faces to the outside of the baffle; a sounding board (8) that is attached to the bottom plate or an inner surface of the top plate and includes a first member (8*b*, 8*c*) having a fiber direction in a direction which approaches one of the first side plate and the second side plate as extending from a side of the back plate to a side of the baffle.

It is preferred that the sounding board further includes a second member (8*a*) having a fiber direction in a vibration direction of the vibrating plate.

It is preferred that the sounding board further includes a third member (8*b*, 8*c*) having a fiber direction in a direction which approaches the other of the first side plate and the second side plate as extending from the side of the back plate to the side of the baffle.

It is preferred that the second member is arranged on a substantial center of a width direction of the bottom plate or the top plate, and the first member and the third member are arranged such that the second member is sandwiched between the first member and the third member.

It is preferred that the sounding board further includes a fourth member (8*d*) attached to the first to third members and having a fiber direction in a direction which approaches the first side plate as extending from the side of the back plate to the side of the baffle, and a fifth member (8*e*) attached to the first to third members and having a fiber direction in a direction which approaches the second side plate as extending from the side of the back plate to the side of the baffle.

It is preferred that the lengths of the fourth and fifth members are shorter than those of the first to third member.

It is preferred that the fourth and fifth members are attached to a middle portion of the longitudinal direction of the first to third members such that the fourth and fifth members are away from an end portion of the side of the back plate and an end portion of the side of the baffle of the first to third members.

It is preferred that the bottom plate or the top plate is a wooden plate cut from solid wooden, and the bottom plate or the top plate has a grain direction crossing the vibration direction of the vibrating plate.

It is preferred that the sounding board is made of bamboo bonded block.

It is preferred that the speaker further comprising: a terminal plate (10) that is attached to the back plate; and a duct (11) for bass reflex that is attached to the back plate, wherein the terminal plate is arranged on the lower side of the back plate and the duct is arranged on the upper side of the back plate.

According to the speaker of the present invention, sound generated by an enclosure can be improved, which realizes further high sound quality.

DESCRIPTION OF THE PREFERRED EMBODIMENTS

A speaker according to an exemplary embodiment of the present invention will be described below, with reference to FIGS. 1 to 14C.

Figure 1:
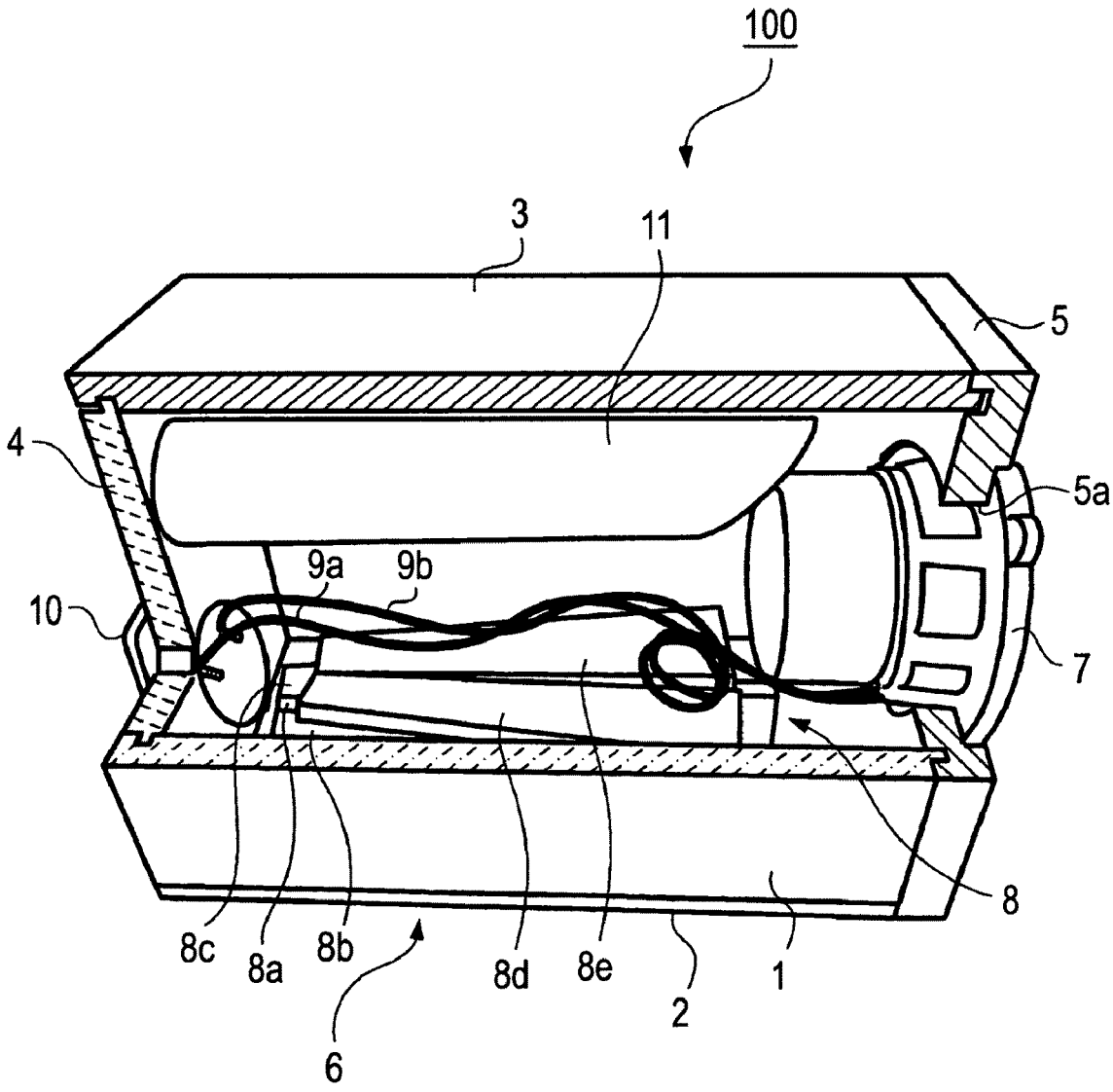
FIG. 1 is a rupture perspective view of a speaker according to an exemplary embodiment of the present invention.
Figure 2:
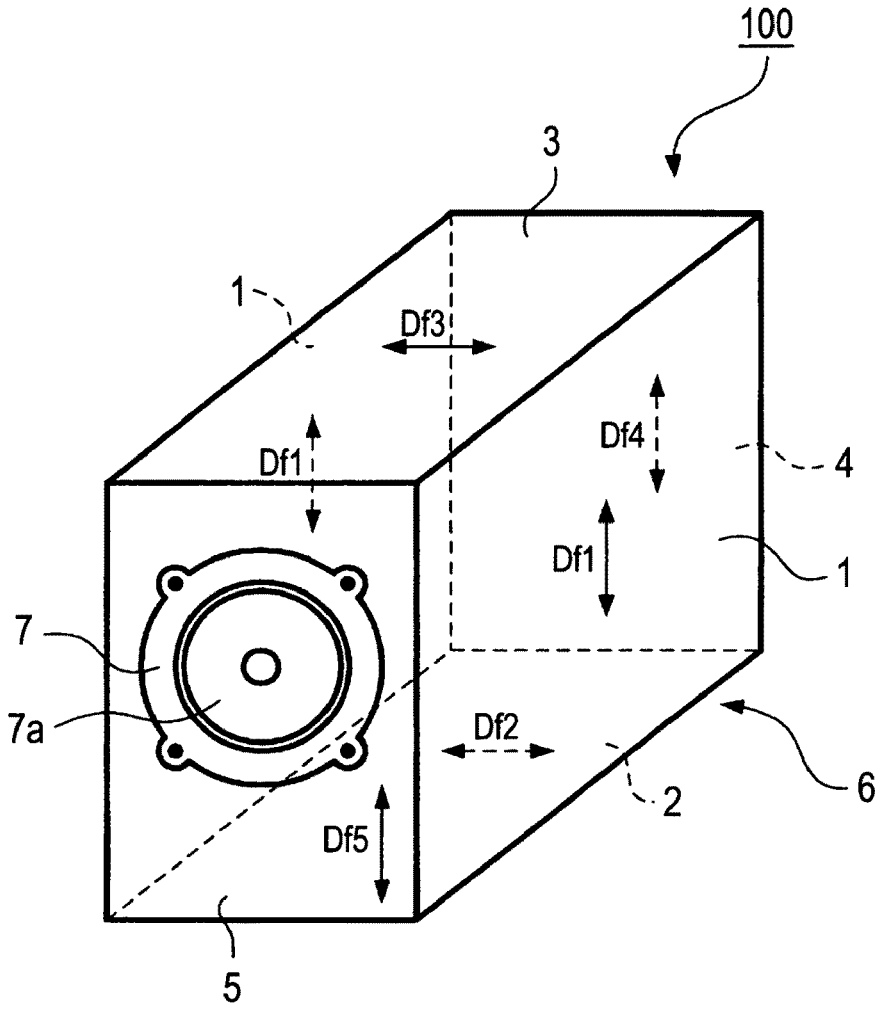
FIG. 2 is an external perspective view of the speaker according to the exemplary embodiment of the present invention.

As shown in FIGS. 1 and 2, a speaker 100 includes an enclosure 6 and a speaker unit 7. A pair of side plates 1 and 1, a bottom plate 2, a top plate 3, a back plate 4 and a baffle (front plate) 5 are assembled into the box-shaped enclosure 6. The baffle 5 is provided with a circular opening portion 5*a*. The speaker unit 7 is attached to the opening portion 5*a* such that a vibrating plate 7*a* of the speaker unit 7 faces to the outside of the enclosure 6. A wooden vibrating plate (wood cone) is suitable as the vibrating plate 7*a*. It is noted that FIG. 1 shows a cut model of the speaker 100 in which the side plate 1 (of the front side of FIG. 1), the top plate 3, the back plate 4 and the baffle 5 are partly cut such that the inside of the enclosure 6 is exposed.

Wooden plates each of which is a piece of solid wood (cut from solid wood) are suitable as the side plates 1 and 1, the bottom plate 2, the top plate 3, the back plate 4 and the baffle 5 of the enclosure 6. Instead of the wooden plate which is a piece of solid wood, a laminated plate may be suitable as the back plate 4. In a case where the side plates 1 and 1, the bottom plate 2, the top plate 3, the back plate 4 and the baffle 5 are the wooden plates, as shown in FIG. 2 where the speaker 100 is normally set, it is preferred that grain directions (wood-grain directions) Df1 and Df1 of the side plates 1 and 1, a grain direction Df4 of the back plate 4 and a grain direction Df5 of the baffle 5 are parallel to a vertical direction of the speaker 100, and a grain direction Df2 of the bottom plate 2 and a grain direction Df3 of the top plate 3 are parallel to a horizontal direction of the speaker 100. The grain directions Df2 and Df3 are directions crossing a direction (vibration direction of the vibrating plate 7*a*) in which sound is emitted from the vibrating plate 7*a* of the speaker unit 7. It is noted that Young's modulus of respective plates 1 to 5 in the grain directions Df1 to Df5 is about 8.3 GPa and Young's modulus of respective plates 1 to 5 in directions perpendicular to the grain directions Df1 to Df5 is about 0.6 GPa.

Figure 3:
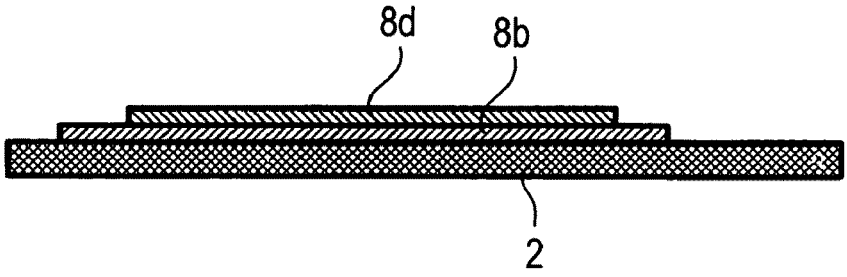
FIG. 3 is a partial cross sectional view of the speaker according to the exemplary embodiment of the present invention.

As shown in FIG. 1, in order to reinforce the bottom plate 2 and increase quality of sound generated by the enclosure 6, a sounding board 8 is attached on the bottom plate 2 within the enclosure 6. The sounding board 8 can be called a reinforcing member for reinforcing the bottom plate 8 or a sound quality increasing member for increasing sound quality. As a preferred example of structure, the sounding board 8 is formed by connecting five members, which are lower members 8*a*, 8*b* and 8*c* and upper members 8*d* and 8*e*, using an adhesive agent or the like. The sounding board 8 is attached on the bottom plate 2 using an adhesive agent or the like. FIG. 3 illustrates that the bottom plate 2 and the sounding board 8 are cut in a longitudinal direction of the sounding board 8 at a portion where the members 8*b* and 8*d* overlap each other. It is noted that although the sounding board 8 is composed of the five members 8*a* to 8*e*, it may be composed of only the lower members 8*a* to 8*c*. However, it is preferred that the sounding board 8 is composed of an upper layer and a lower layer as shown in FIGS. 1 and 3 because an effect that sound quality is improved is large.

Each of the members 8*a* to 8*e* is made of anisotropic material. As a preferred material, wood or bamboo is cited. It is preferable to use bamboo as material of the members 8*a* to 8*e* because an effect that sound quality is improved by using bamboo is larger than one by using wood. In a case of using bamboo as material of the members 8*a* to 8*e*, the sounding board 8 is called a bamboo sounding board. In the exemplary embodiment, bamboo is used as material of the members 8*a* to 8*e*.

As shown in FIG. 1, a plus side cable 9*a* and a minus side cable 9*b* drawn from the speaker unit 7 are connected to a plus side terminal and a minus side terminal mounted on an inner surface of a terminal plate 10 attached to the back plate 4. A speaker cable (not shown) drawn from an amplifier (not shown) is connected to a plus side terminal and a minus side terminal mounted on an outer surface of the terminal plate 10. A duct for bass reflex 11 is attached to an upper portion of the enclosure 6 so as not to contact an inner surface of the top plate 3. The duct 11 is fixed to the back plate 4 using adhesive agent or the like in a state where an opening portion formed on the back plate 4 is opposed to one open end of the duct 11. The other open end of the duct 11 is located at a position adjacent to the speaker unit 7. The duct 11 intensifies low pitch sound. In the exemplary embodiment, since the sounding board 8 is attached to the bottom plate 2, it is preferable that the terminal plate 10 is mounted to a lower side in the enclosure 6 and the duct 11 is mounted to an upper side in the enclosure 6.

A configuration of the sounding board 8 will be described below in detail, with reference to FIGS. 4 to 6.

Figure 4:
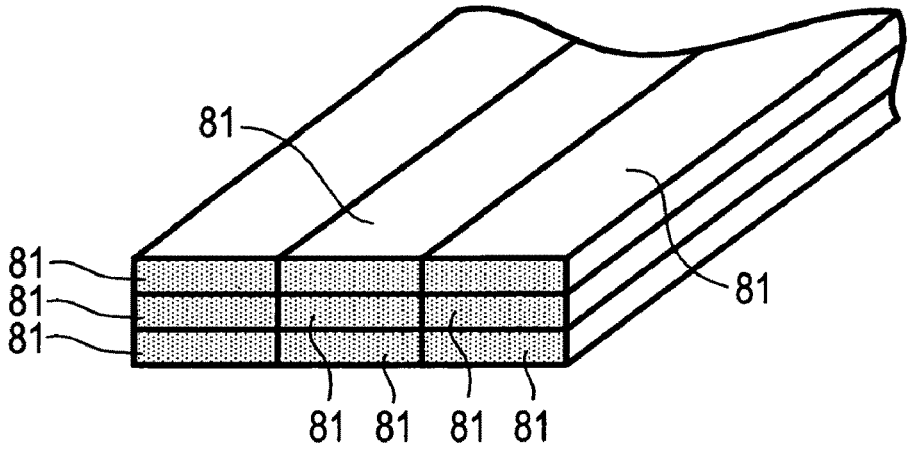
FIG. 4 is a perspective view of a bamboo bonded block by which each member of a sounding board of the speaker is formed according to the exemplary embodiment of the present invention.
Figure 5A:
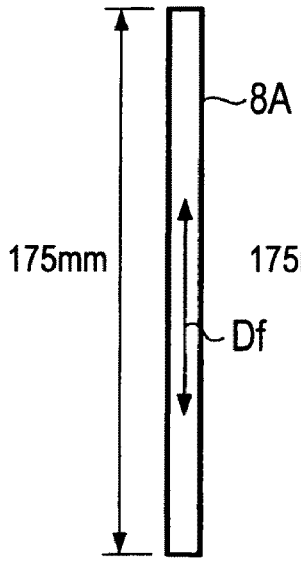
FIGS. 5A to 5C are plane views each that illustrates a bamboo bonded block constituting each member of the sounding board of the speaker according to the exemplary embodiment of the present invention.
Figure 5B:
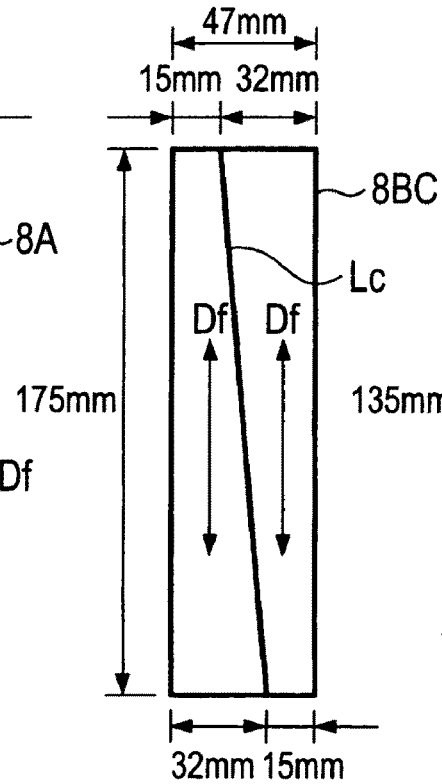
Figure 5C:
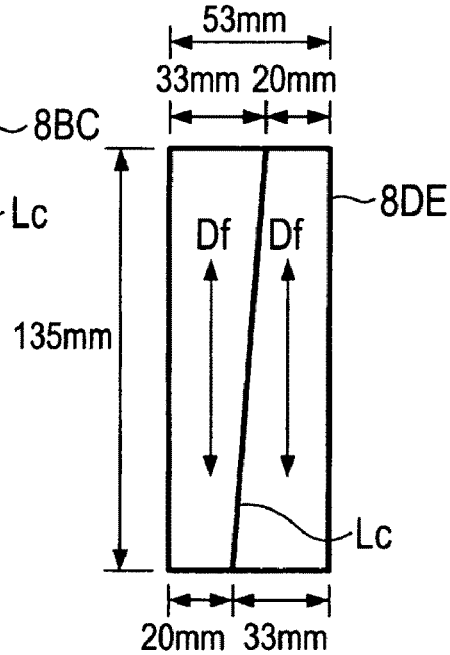

As shown in FIG. 4, each of the members 8*a* to 8*e* of the sounding board 8 is formed by a bamboo bonded block in which a plurality of pieces of bamboo 81 is aligned and laminated. FIGS. 5A, 5B and 5C respectively illustrate a bamboo bonded block 8A constituting the member 8*a*, a bamboo bonded block 8BC constituting the members 8*b* and 8*c*, a bamboo bonded block 8DE constituting the members 8*d* and 8*e*. The bamboo bonded blocks 8A, 8BC and 8DE have fiber directions Df indicated by arrows in FIGS. 5A to 5C. One example of sizes of the bamboo bonded block 8A, 8BC and 8DE is as follows. The bamboo bonded block 8A has 12 mm in width, 175 mm in length and 15 mm in thickness. The bamboo bonded block 8BC has 47 mm in width, 175 mm in length and 15 mm in thickness. The bamboo bonded block 8DE has 53 mm in width, 135 mm in length and 15 mm in thickness. The number of pieces of bamboo 81 to be aligned depends on the width of each bamboo bonded block.

The bamboo bonded block 8A is the member 8*a* of the sounding board 8 by itself. After the bamboo bonded block 8BC is cut along a cutting plane line Lc, two pieces of bamboo bonded block 8BC are the members 8*b* and 8*c*. After the bamboo bonded block 8DE is cut along a cutting plane line Lc, two pieces of bamboo bonded block 8DE are the members 8*d* and 8*e*.

Figure 6A:
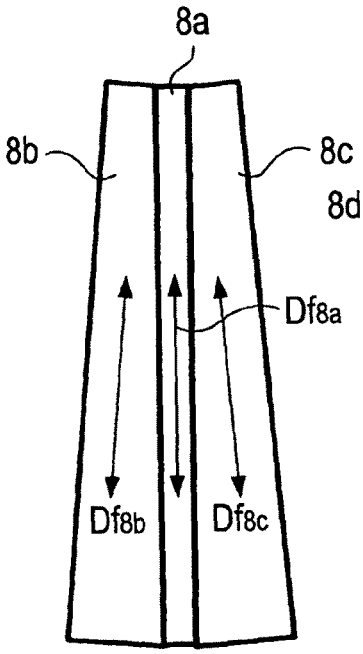
FIG. 6A is a plane view of a lower layer of the sounding board of the speaker according to the exemplary embodiment of the present invention.

As shown in FIG. 6A, the members 8*b* and 8*c* are bonded to the member 8*a* so that sides of the cutting plane lines Lc of the members 8*b* and 8*c* are opposed to both long sides of the member 8*a*, which forms a lower layer member of the sounding board 8. Under this configuration, the fiber directions $Df_{8b}$ and $Df_{8c}$ of the members 8*b* and 8*c* extend outward as extending from the upper side to the lower side of FIG. 6A (that is, the fiber direction $Df_{8a}$ of the member 8*a* extends from the upper side to the lower side of the member 8*a*).

Figure 6B:
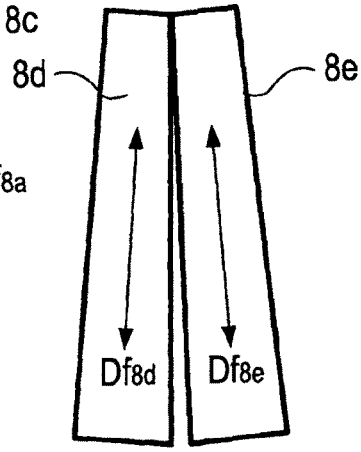
FIG. 6B is a plane view of an upper layer of the sounding board of the speaker according to the exemplary embodiment of the present invention.

As shown in FIG. 6B, the member 8*d* is bonded to the member 8*e* so that a side of the cutting plane line Lc of the member 8*d* is opposed to a side of the cutting plane line Lc of the member 8*e*, which forms an upper layer member of the sounding board 8. Under this configuration, the fiber directions $Df_{8d}$ and $Df_{8e}$ of the members 8*d* and 8*e* extend outward as extending from the upper side to the lower side of FIG. 6B. It is noted that, in FIG. 6B, an upper part with narrow width of the side of the cutting plane line Lc of the member 8*d* contacts an upper part with narrow width of the side of the cutting plane line Lc of the member 8*e*, and a lower part with broad width of the side of the cutting plane line Lc of the member 8*d* separates a lower part with broad width of the side of the cutting plane line Lc of the member 8*e*. All part of the side of the cutting plane line Lc of the member 8*d* may contact all part of the side of the cutting plane line Lc of the member 8*e*.

Figure 6C:
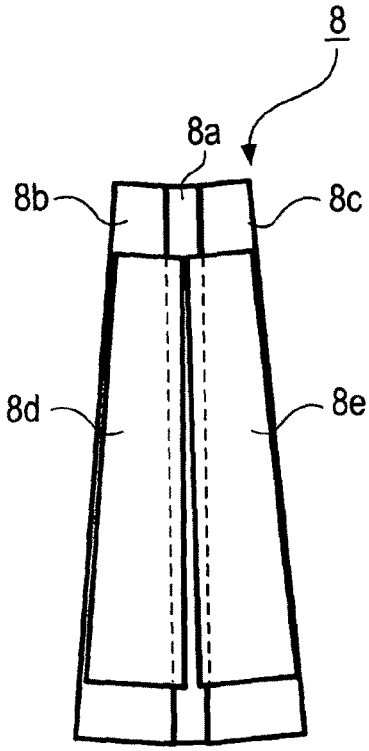
FIG. 6C is a plane view of the sounding board of the speaker according to the exemplary embodiment of the present invention.

The upper layer member composed of the members 8*d* and 8*e* is placed on the lower layer member composed of the members 8*a* to 8*c* to which an adhesive agent or the like is applied, and integrated with the lower layer member, which form the sounding board 8 shown in FIG. 6C. It is preferable that the upper layer member is shorter than the lower layer member. A position where the upper layer member is located on the lower layer member in a longitudinal direction thereof is not limited to the position shown in FIG. 6C. However, it is preferable that the upper layer member is placed on the lower layer member so that both end portions of the lower layer member in the longitudinal direction thereof are exposed.

As shown in FIG. 1, the sounding board 8 is attached to the bottom plate 2 in a state where the lower side of sounding board 8 shown in FIG. 6C faces to a front surface side of the speaker 100 (side of the baffle 5) and the upper side of sounding board 8 shown in FIG. 6C faces to a back surface side of the speaker 100 (side of the back plate 4). It is preferable that the member 8*a* is arranged on a substantial center of the bottom plate 2 in a width direction of the bottom plate 2. The fiber direction $Df_{8a}$ of the member 8*a* is substantially parallel to the side plates 1 and 1 and is substantially vertical to a surface of the baffle 5. Namely, the fiber direction $Df_{8a}$ of the member 8*a* is substantially parallel to a vibration direction of the vibrating plate 7*a*. The fiber direction $Df_{8b}$ of the member 8*b* is a direction of approaching the side plate 1 located at the front side of FIG. 1 as extending from the back surface side to the front surface side of the speaker 100. The fiber direction $Df_{8c}$ of the member 8*c* is a direction of approaching the side plate 1 located at the back side of FIG. 1 as extending from the back surface side to the front surface side of the speaker 100. Namely, the fiber directions $Df_{8b}$ and $Df_{8c}$ extend outward in the width direction of the bottom plate 2 as extending from the back surface side to the front surface side of the speaker 100.

The fiber direction $Df_{8d}$ of the member 8*d* is a direction of approaching the side plate 1 located at the front side of FIG. 1 as extending from the back surface side to the front surface side of the speaker 100. The fiber direction $Df_{8e}$ of the member 8*e* is a direction of approaching the side plate 1 located at the back side of FIG. 1 as extending from the back surface side to the front surface side of the speaker 100. Namely, the fiber directions $Df_{8d}$ and $Df_{8e}$ extend outward in the width direction of the bottom plate 2 as extending from the back surface side to the front surface side of the speaker 100.

Although the sounding board 8 shown in FIG. 6C is a preferable configuration example, the configuration of the sounding board 8 is not limited to it. Although it is preferable that the member 8*a* with the fiber direction $Df_{8a}$, which is substantially parallel to the vibration direction of the vibrating plate 7*a*, is arranged on the substantial center of the bottom plate 2 in a width direction of the bottom plate 2 and sandwiched between the members 8*b* and 8*c*, the configuration of the lower layer member of the sounding board 8 is not limited it. It is only necessary that the sounding board 8 includes a portion having a fiber direction substantially parallel to the vibration direction of the vibrating plate 7*a* and a portion having a fiber direction extending outward as extending from the back surface side to the front surface side of the speaker 100.

Since the enclosure 6 includes the sounding board 8 having the above-described configuration, the speaker 100 can realize that the center of low pitch sound lowers in hearing sensation to increase resolution of low pitch sound. This allows a sound field to spread from side to side in a midrange, which provides sound reproduction with rich sound field.

A speaker of the present invention is not limited to the speaker 100 according to the exemplary embodiment, and the sounding board 8 may include only a portion having a fiber direction extending outward as extending from the back surface side to the front surface side of the speaker 100. Speakers according to modifications of the exemplary embodiment will be described below, with reference to FIGS. 7A and 7B.

Figure 7A:
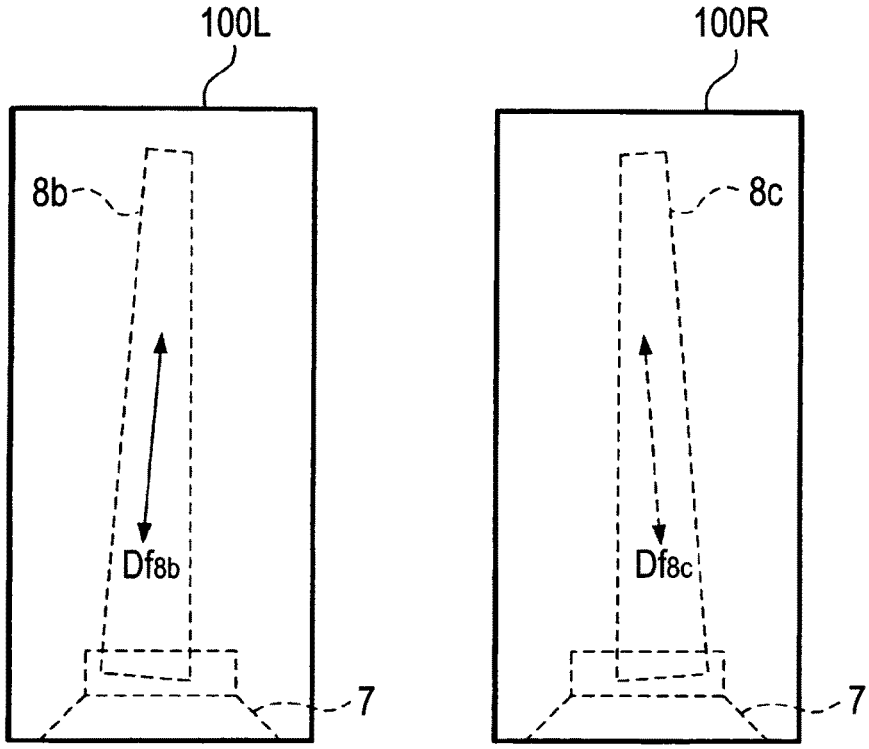
FIGS. 7A and 7B are plane views of speakers according to modifications of the exemplary embodiment of the present invention.

FIG. 7A illustrates that a sounding board including only the member 8*b* or 8*c* is attached on the bottom plate 2, instead of the sounding board 8 including the members 8*a* to 8*e*. In FIG. 7A, speakers 100L and 100R are left and right speakers. As shown in FIG. 7A, by attaching the member 8*b* and the member 8*c* on the bottom plates 2 and 2 of the speakers 100L and 100R, the fiber directions $Df_{8b}$ and $Df_{8c}$ extend outward as extending from the back surface side to the front surface side thereof. This allows a sound field to spread outward.

Figure 7B:
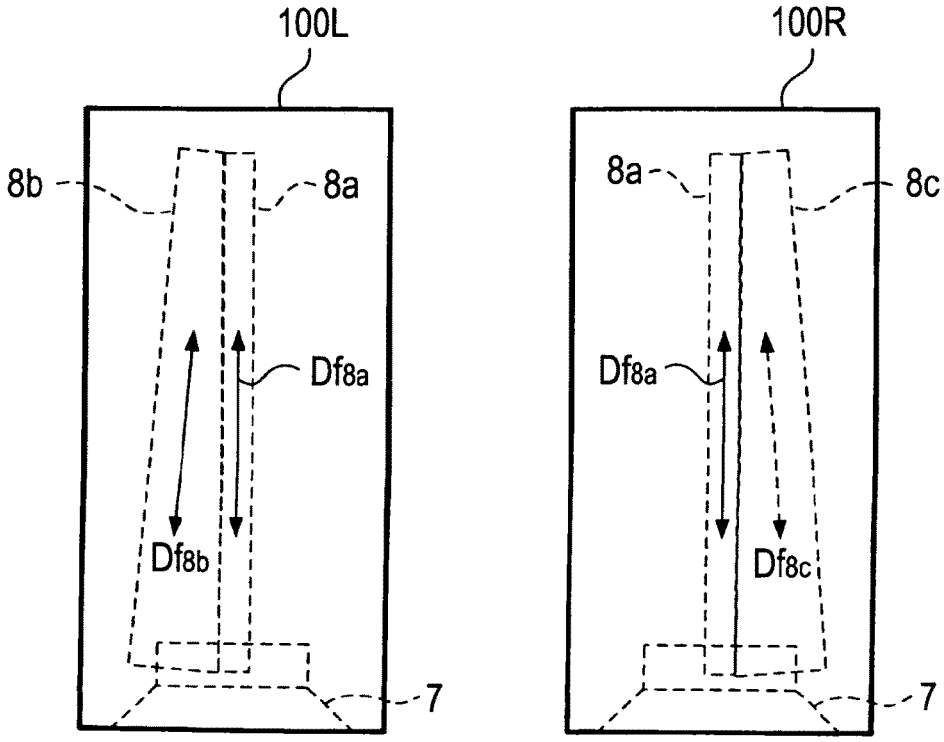

FIG. 7B illustrates that a sounding board including the members 8*a* and 8*b* or the members 8*a* and 8*c* is attached on the bottom plate 2. It is noted that the member 8*a* has the fiber direction $Df_{8a}$ substantially parallel to the vibration direction of the vibrating plate 7*a*. By attaching the members 8*a* and 8*a* on the bottom plates 2 and 2 of the speakers 100L and 100R in addition to the configuration shown in FIG. 7A, sound is easily transmitted to the vibration direction of the vibrating plate 7*a* (that is, a front side direction of the speakers 100L and 100R). This allows sound to be transmitted to a listener who is positioned to the front side of the speakers 100L and 100R, in addition to allowing a sound field to spread outward.

In the exemplary embodiment, the sounding board 8 including the members 8*a* to 8*e* is attached on the bottom plate 2. In the modifications of the exemplary embodiment, the sounding boards including the member 8*b* and the member 8*c* are attached on the bottom plates 2 and 2 or the sounding boards including the members 8*a* and 8*b* and the members 8*a* and 8*c* are attached on the bottom plates 2 and 2. It is noted that each sounding board may be attached on an inner surface of the top plate 3. Even if the sounding board 8 including the members 8*a* to 8*e*, the sounding boards including the member 8*b* and the member 8*c*, or the sounding boards including the members 8*a* and 8*b* and the members 8*a* and 8*c* is/are attached on the inner surface(s) of the top plate(s) 3, each speaker can spread a sound field outward. However, in a case where the sounding board 8 including the members 8*a* to 8*e*, the sounding boards including the member 8*b* and the member 8*c*, or the sounding boards including the members 8*a* and 8*b* and the members 8*a* and 8*c* is/are attached on the inner surface(s) of the top plate(s) 3, each speaker does not very obtain the effect that the center of low pitch sound lowers in hearing sensation to increase resolution of low pitch sound. For this reason, it is preferable that the sounding board 8 including the members 8*a* to 8*e*, the sounding boards including the member 8*b* and the member 8*c*, or the sounding boards including the members 8*a* and 8*b* and the members 8*a* and 8*c* is/are attached on the bottom plate(s) 2.

Figure 8:
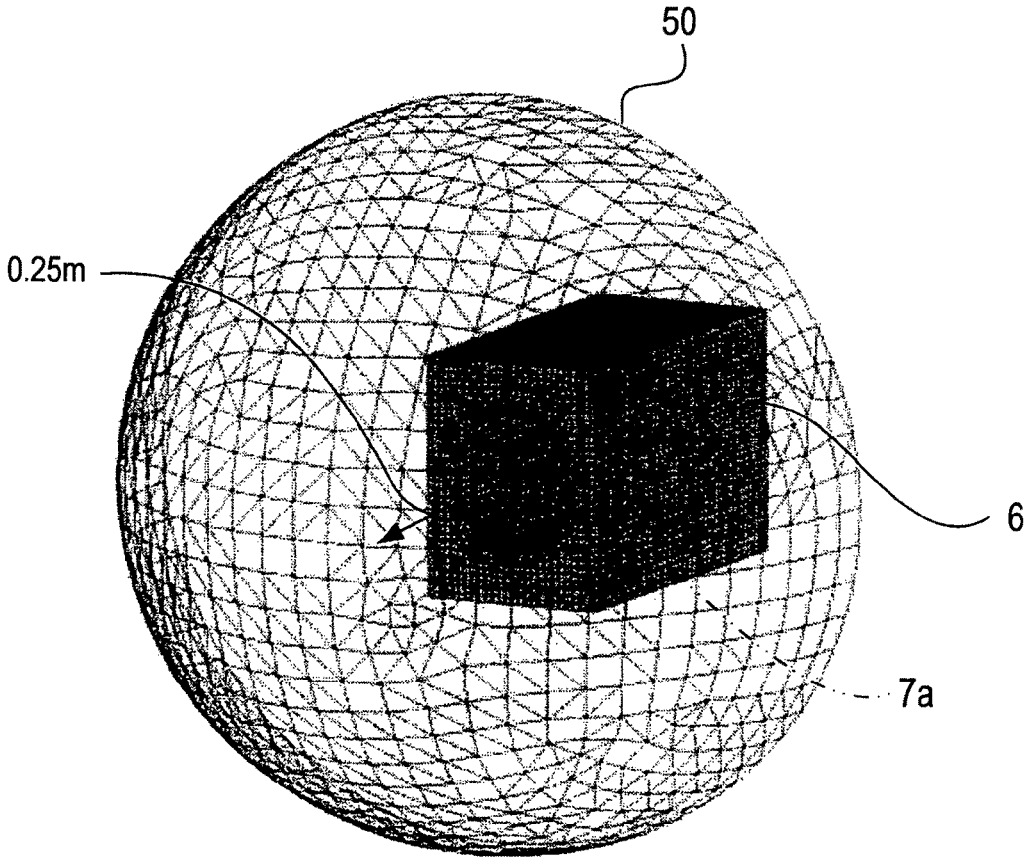
FIG. 8 is a diagram that illustrates an acoustic simulation model according to the exemplary embodiment of the present invention.

Next, effects generated by the speaker 100 with the sounding board 8 will be described based on data measured using an acoustic simulation model, with reference to FIGS. 8 to 14C. FIG. 8 illustrates an acoustic simulation model that calculates sound pressure and the like of only the enclosure 6 at the time when the enclosure 6 vibrates according to the vibration of vibrating plate 7*a*. A mesh hemisphere 50 with a radius of 0.25 m is set around the center of the vibrating plate 7*a*. Each surface of the enclosure 6 is cellularly divided. In order to plot the hemisphere 50 as a substantially perfect hemisphere, each cell of the hemisphere 50 has a square shape or a triangular shape. As an example, analysis results of sound pressure and the like of only the enclosure 6 at the time when force of $1.4\times10^{5}$N is applied to a voice coil (not shown) of the speaker unit 7 to vibrate the vibrating plate 7*a*.

Figure 9A:
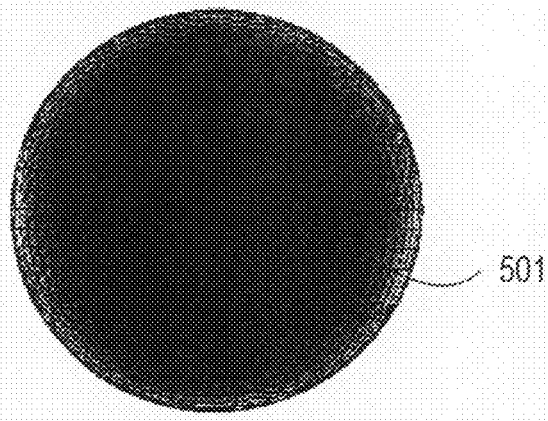
FIGS. 9A to 9C are diagrams that illustrate an analysis result of the acoustic simulation model at a frequency of 250 Hz according to a comparison example with respect to the exemplary embodiment of the present invention.
Figure 9B:
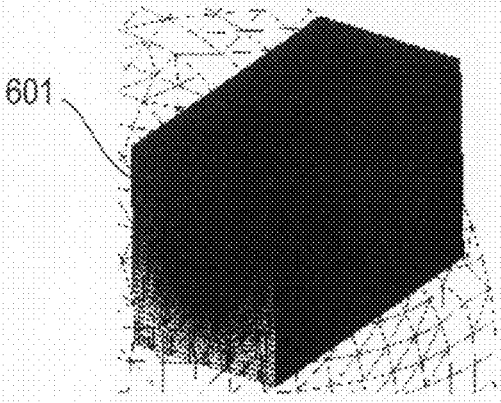
Figure 9C:
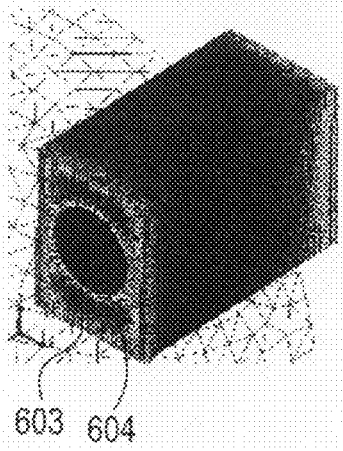
Figure 10A:
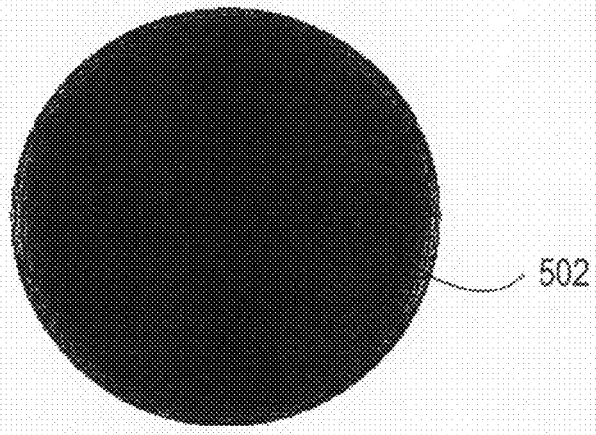
FIGS. 10A to 10C are diagrams that illustrate an analysis result of the acoustic simulation model at a frequency of 250 Hz according to the exemplary embodiment of the present invention.
Figure 10B:
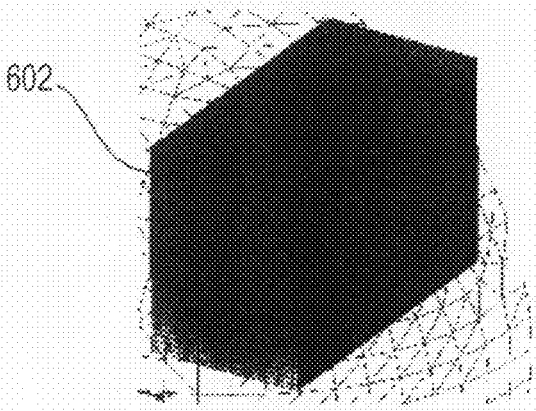
Figure 10C:
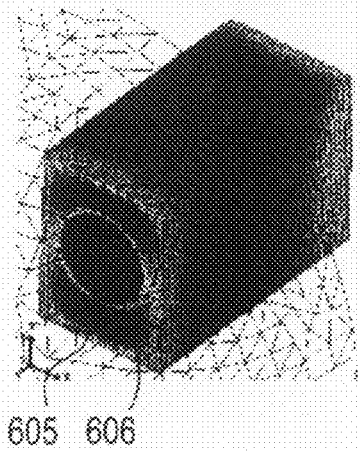

FIGS. 9A to 9C illustrate an analysis result at a frequency of 250 Hz in a speaker which is not provided with the sounding board 8 according to a comparison example with respect to the exemplary embodiment. FIG. 9A illustrates a level of sound pressure in a normal direction with respect to each cell of the hemisphere 50. FIG. 9B illustrates amplitude of particle velocity in a normal direction with respect to each cell of respective surfaces of the enclosure 6. FIG. 9C illustrates amplitude of sound pressure in a normal direction in each cell of respective surfaces of the enclosure 6. FIGS. 10A to 10C illustrate an analysis result at a frequency of 250 Hz in the speaker 100 which is provided with the sounding board 8 according to the exemplary embodiment. FIG. 10A illustrates a level of sound pressure in a normal direction with respect to each cell of the hemisphere 50. FIG. 10B illustrates amplitude of particle velocity in a normal direction with respect to each cell of respective surfaces of the enclosure 6. FIG. 10C illustrates amplitude of sound pressure in a normal direction in each cell of respective surfaces of the enclosure 6.

Comparing FIG. 9A with FIG. 10A, while the level of sound pressure is about −4.8 dB at the center 501 of the hemisphere 50 in FIG. 9A, the level of sound pressure is far larger than −4.8 dB at the center 502 of the hemisphere 50 in FIG. 10A because the color density of black at the center 502 in FIG. 10A is darker than that at the center 501 in FIG. 9A. Comparing FIG. 9B with FIG. 10B, while the amplitude of particle velocity is about $1.5\times10^{-8}$ m/s at a portion 601 (portion above the speaker unit 7 of the baffle 5) of the enclosure 6 in FIG. 9B, the amplitude of particle velocity is far larger than $1.5\times10^{-8}$ m/s at a portion 602 (the same portion as the portion 601 in FIG. 9B) of the enclosure 6 in FIG. 10B because the color density of black in FIG. 10B at the portion 602 is darker than that in FIG. 9B at the portion 601.

Comparing FIG. 9C with FIG. 10C, while the amplitude of sound pressure is about $8.5\times10^{-7}$ Pa at portions 603 and 604 (portions below and above the speaker unit 7 of the baffle 5) of the enclosure 6 in FIG. 9C, the amplitude of sound pressure is far larger than $8.5\times10^{-7}$ Pa at portions 605 and 606 (the same portions as the portions 603 and 604 in FIG. 9C) of the enclosure 6 in FIG. 10C because the color densities of black in FIG. 10C at the portions 605 and 606 are darker than those in FIG. 9C at the portions 603 and 604.

Figure 11A:
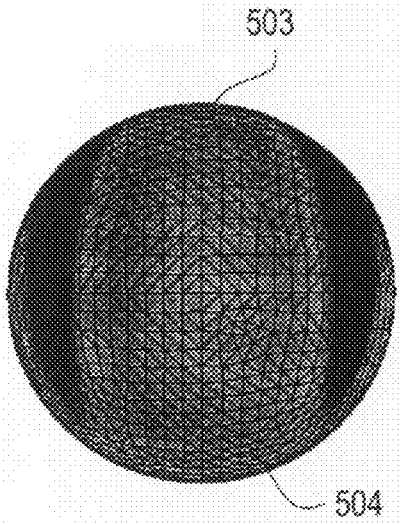
FIGS. 11A to 11C are diagrams that illustrate an analysis result of the acoustic simulation model at a frequency of 950 Hz according to a comparison example with respect to the exemplary embodiment of the present invention.
Figure 11B:
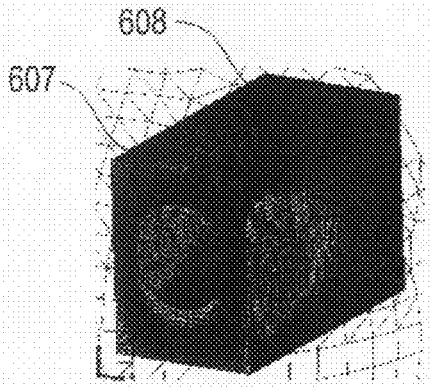
Figure 11C:
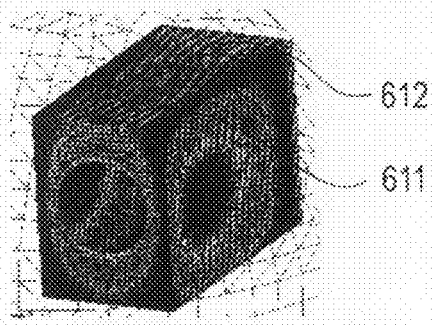
Figure 12A:
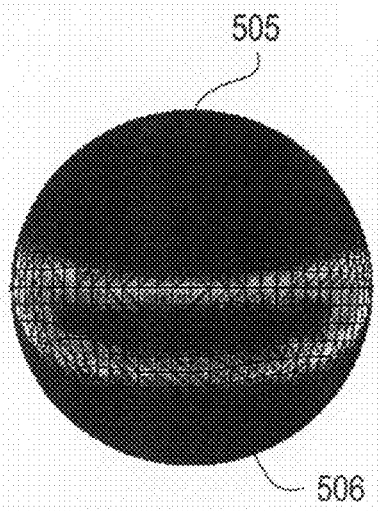
FIGS. 12A to 12C are diagrams that illustrate an analysis result of the acoustic simulation model at a frequency of 950 Hz according to the exemplary embodiment of the present invention.
Figure 12B:
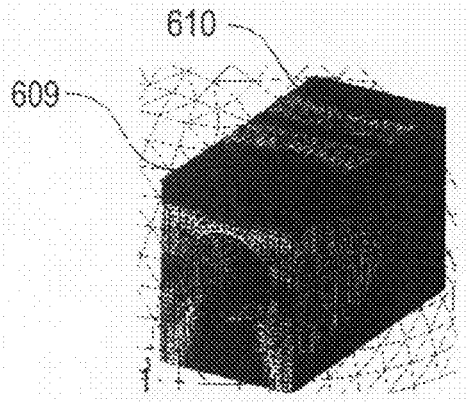
Figure 12C:
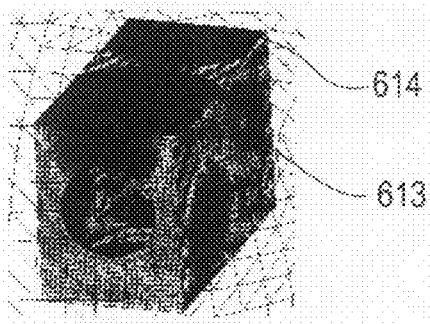

FIGS. 11A to 11C illustrate an analysis result at a frequency of 950 Hz in a speaker which is not provided with the sounding board 8 according to a comparison example with respect to the exemplary embodiment. FIG. 11A illustrates a level of sound pressure in a normal direction with respect to each cell of the hemisphere 50. FIG. 11B illustrates amplitude of particle velocity in a normal direction with respect to each cell of respective surfaces of the enclosure 6. FIG. 11C illustrates amplitude of sound pressure in a normal direction in each cell of respective surfaces of the enclosure 6. FIGS. 12A to 12C illustrate an analysis result at a frequency of 950 Hz in the speaker 100 which is provided with the sounding board 8 according to the exemplary embodiment. FIG. 12A illustrates a level of sound pressure in a normal direction with respect to each cell of the hemisphere 50. FIG. 12B illustrates amplitude of particle velocity in a normal direction with respect to each cell of respective surfaces of the enclosure 6. FIG. 12C illustrates amplitude of sound pressure in a normal direction in each cell of respective surfaces of the enclosure 6.

Comparing FIG. 11A with FIG. 12A, while the level of sound pressure is about −7.2 dB at end portions 503 and 504 of the hemisphere 50 in FIG. 11A, the level of sound pressure is far larger than −7.2 dB at end portions 505 and 506 of the hemisphere 50 in FIG. 12A because the color densities of black at the end portions 505 and 506 in FIG. 12A are darker than that at the end portions 503 and 504 in FIG. 11A. It is noted that the level of sound pressure is larger than −6.5 dB at the end portions 505 and 506. Comparing FIG. 11B with FIG. 12B, while the amplitude of particle velocity is about $1.0\times10^{-18}$ m/s at end portions 607 and 608 (end portions of the top plate 3) of the enclosure 6 in FIG. 11B, the amplitude of particle velocity is far larger than $1.0\times10^{-18}$ m/s at end portions 609 and 610 (the same portions as the end portions 607 and 608 in FIG. 11B) of the enclosure 6 in FIG. 12B because the color densities of black in FIG. 12B at the end portions 609 and 610 are darker than those in FIG. 11B at the end portions 607 and 608. It is noted that the amplitude of particle velocity is larger than $3.5\times10^{-10}$ m/s at the end portions 609 and 610.

Comparing FIG. 11C with FIG. 12C, while the amplitude of sound pressure is about $2.5\times10^{-8}$ Pa at portions 611 and 612 (end portions of the top plate 3) of the enclosure 6 in FIG. 11C, the amplitude of sound pressure is far larger than $2.5\times10^{-8}$ Pa at portions 613 and 614 (the same portions as the end portions 611 and 612 in FIG. 11C) of the enclosure 6 in FIG. 12C because the color densities of black in FIG. 12C at the portions 613 and 614 are darker than those in FIG. 11C at the portions 611 and 612. It is noted that the amplitude of sound pressure is larger than $7.0\times10^{-8}$ Pa at the end portions 613 and 614.

Figure 13A:
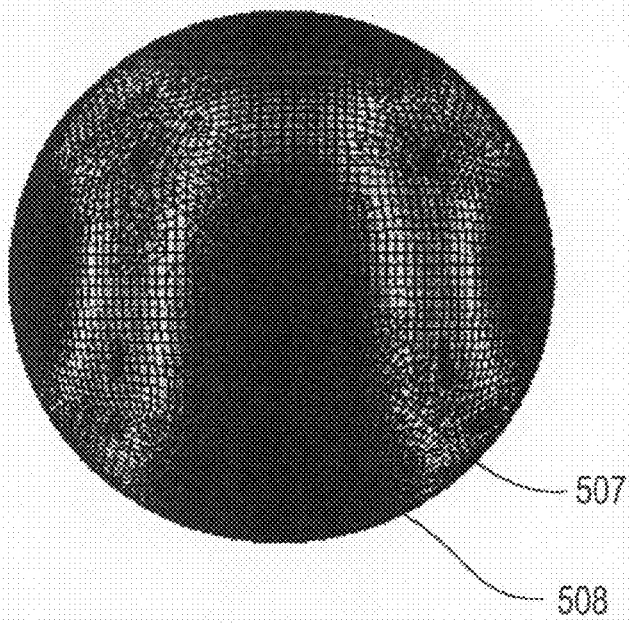
FIGS. 13A to 13C are diagrams that illustrate an analysis result of the acoustic simulation model at a frequency of 2500 Hz according to a comparison example with respect to the exemplary embodiment of the present invention.
Figure 13B:
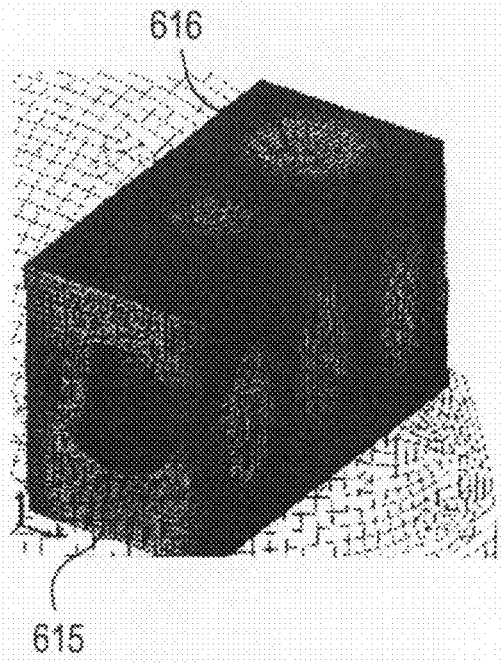
Figure 13C:
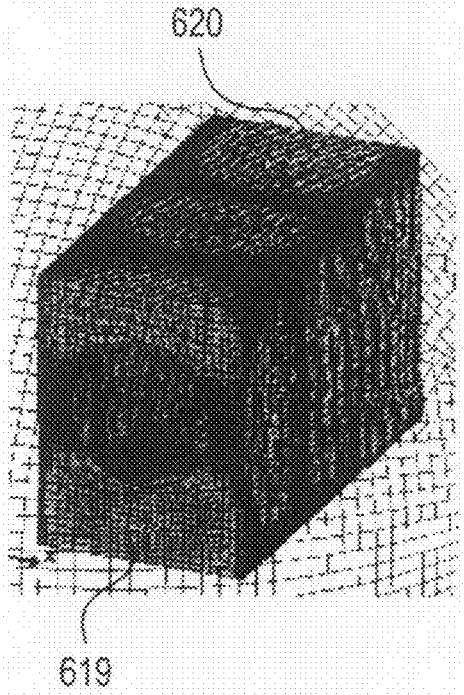
Figure 14A:
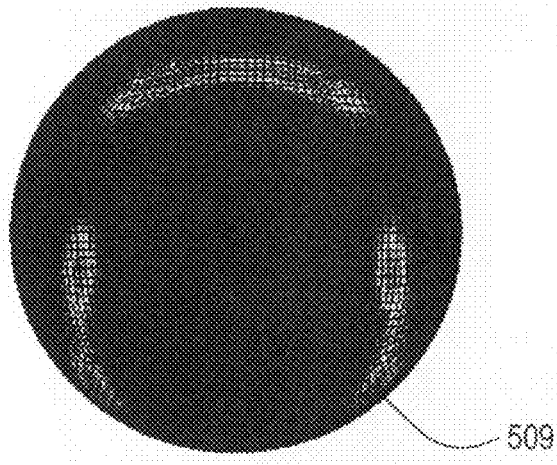
FIGS. 14A to 14C are diagrams that illustrate an analysis result of the acoustic simulation model at a frequency of 2500 Hz according to the exemplary embodiment of the present invention.
Figure 14B:
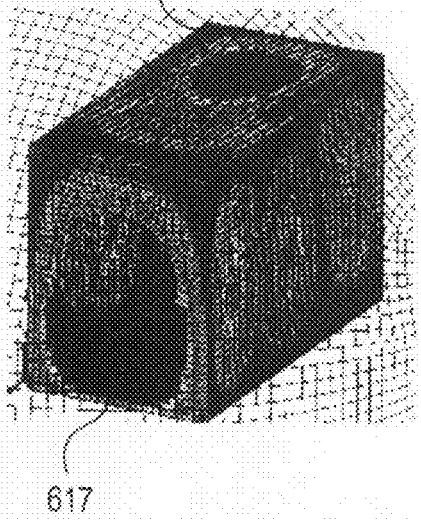
Figure 14C:
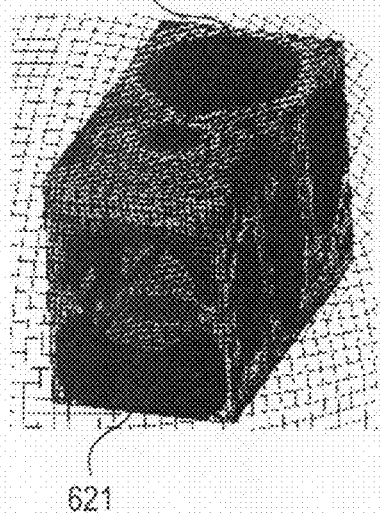

FIGS. 13A to 13C illustrate an analysis result at a frequency of 2500 Hz in a speaker which is not provided with the sounding board 8 according to a comparison example with respect to the exemplary embodiment. FIG. 13A illustrates a level of sound pressure in a normal direction with respect to each cell of the hemisphere 50. FIG. 13B illustrates amplitude of particle velocity in a normal direction with respect to each cell of respective surfaces of the enclosure 6. FIG. 13C illustrates amplitude of sound pressure in a normal direction in each cell of respective surfaces of the enclosure 6. FIGS. 14A to 14C illustrate an analysis result at a frequency of 2500 Hz in the speaker 100 which is provided with the sounding board 8 according to the exemplary embodiment. FIG. 14A illustrates a level of sound pressure in a normal direction with respect to each cell of the hemisphere 50. FIG. 14B illustrates amplitude of particle velocity in a normal direction with respect to each cell of respective surfaces of the enclosure 6. FIG. 14C illustrates amplitude of sound pressure in a normal direction in each cell of respective surfaces of the enclosure 6.

Comparing FIG. 13A with FIG. 14A, while the level of sound pressure is about −6.0 dB at a portion 507 of the hemisphere 50 and the level of sound pressure is larger then −6.0 dB in a small area 508 in FIG. 13A, the level of sound pressure is far larger than −6.0 dB in a large area 509 of the hemisphere 50 in FIG. 14A because the color density of black in the large area 509 in FIG. 14A is darker than those at the portion 507 and in the small area 508 in FIG. 13A. Comparing FIG. 13B with FIG. 14B, while the amplitude of particle velocity is about $3.0\times10^{-10}$ m/s at a portion 615 (portion below the speaker unit 7 of the baffle 5) and a portion 616 (end portion of the top plate 3) of the enclosure 6 in FIG. 13B, the amplitude of particle velocity is far larger than $5.5\times10^{-10}$ m/s at portions 617 and 618 (the same portions as the portions 615 and 616 in FIG. 13B) of the enclosure 6 in FIG. 14B because the color densities of black in FIG. 14B at the portions 617 and 618 are darker than those in FIG. 13B at the portions 615 and 616.

Comparing FIG. 13C with FIG. 14C, while the amplitude of sound pressure is about $1.2\times10^{-7}$ Pa at a portion 619 (portion below the speaker unit 7 of the baffle 5) and a portion 620 (end portion of the top plate 3) of the enclosure 6 in FIG. 13C, the amplitude of sound pressure is far larger than $2.0\times10^{-7}$ Pa at portions 621 and 622 (the same portions as the portions 619 and 620 in FIG. 13C) of the enclosure 6 in FIG. 14C because the color densities of black in FIG. 14C at the portions 621 and 622 are darker than those in FIG. 13C at the portions 619 and 620.

The above analysis results show that the sound generated by the speaker 100 provided with the sounding board 8 is loud sound in comparison with the sound generated by the speaker not provided with the sounding board 8, wherein the sound is generated by the vibration of the enclosure 6. Since respective numerical values of the level of sound pressure, the amplitude of particle velocity and the amplitude of sound pressure are changed depending on respective simulation conditions, the numerical values shown in FIGS. 9A to 14C are cited as one example. According to the speaker 100 with the sounding board 8, the level of sound pressure, the amplitude of particle velocity and the amplitude of sound pressure increases in a plurality of frequency bands. By causing sound generated by the enclosure 6 to be loud, the speaker 100 can realize that the center of low pitch sound lowers in hearing sensation to increase resolution of low pitch sound, which allows a sound field to be rich in a midrange.

The speaker of the present invention is not limited to the speaker 100 described in the above exemplary embodiment, and various changes may be made without departing from the scope of the present invention.

What is claimed is:

1. A speaker comprising:

a box-shaped enclosure into which a first side plate, a second side plate, a bottom plate, a top plate, a back plate and a baffle with an opening portion are assembled;

a speaker unit that is attached to the opening portion such that a vibrating plate of the speaker unit faces to the outside of the baffle; and a sounding board that is attached to the bottom plate or an inner surface of the top plate and includes a first member having a fiber direction in a direction which approaches one of the first side plate and the second side plate as extending from a side of the back plate to a side of the baffle, wherein the sounding board further includes a third member having a fiber direction in a direction which approaches the other of the first side plate and the second side plate as extending from the side of the back plate to the side of the baffle.

2. The speaker according to claim 1, wherein the sounding board further includes a second member having a fiber direction in a vibration direction of the vibrating plate.

3. The speaker according to claim 2, wherein the second member is arranged on a substantial center of a width direction of the bottom plate or the top plate, and the first member and the third member are arranged such that the second member is sandwiched between the first member and the third member.

4. The speaker according to claim 2, wherein the sounding board further includes a fourth member attached to the first to third members and having a fiber direction in a direction which approaches the first side plate as extending from the side of the back plate to the side of the baffle, and a fifth member attached to the first to third members and having a fiber direction in a direction which approaches the second side plate as extending from the side of the back plate to the side of the baffle.

5. The speaker according to claim 4, wherein the lengths of the fourth and fifth members are shorter than those of the first to third member.

6. The speaker according to claim 5, wherein the fourth and fifth members are attached on a middle portion of the longitudinal direction of the first to third members such that the fourth and fifth members are away from an end portion of the side of the back plate and an end portion of the side of the baffle of the first to third members.

7. The speaker according to claim 1, wherein the bottom plate or the top plate is a wooden plate cut from solid wooden, and the bottom plate or the top plate has a grain direction crossing the vibration direction of the vibrating plate.

8. The speaker according to claim 1, wherein the sounding board is made of bamboo bonded block.

9. The speaker according to claim 1, further comprising:

a terminal plate that is attached to the back plate; and a duct for bass reflex that is attached to the back plate, wherein the terminal plate is arranged on the lower side of the back plate and the duct is arranged on the upper side of the back plate.

* * * * *